US007548144B2

(12) United States Patent
Kim et al.

(10) Patent No.: US 7,548,144 B2
(45) Date of Patent: Jun. 16, 2009

(54) MEMS SWITCH AND METHOD OF FABRICATING THE SAME

(75) Inventors: Che-heung Kim, Yongin-si (KR); Hyung-jae Shin, Seongnam-si (KR); Soon-cheol Kweon, Seoul (KR); Kyu-sik Kim, Suwon-si (KR); Sang-hun Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 329 days.

(21) Appl. No.: 11/251,804

(22) Filed: Oct. 18, 2005

(65) Prior Publication Data

US 2006/0131147 A1 Jun. 22, 2006

(30) Foreign Application Priority Data

Dec. 17, 2004 (KR) ..... 10-2004-0107857

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,578,976 A * 11/1996 Yao ..... 333/262
6,307,169 B1 10/2001 Sun
6,307,452 B1 10/2001 Sun
6,639,494 B1 10/2003 Bluzer
6,657,525 B1 * 12/2003 Dickens et al. ..... 335/78
6,888,420 B2 * 5/2005 Schaffner et al. ..... 333/101
7,157,993 B2 * 1/2007 DeNatale et al. ..... 335/78
7,312,677 B2 * 12/2007 Nakatani et al. ..... 335/78
2003/0178635 A1 9/2003 Volant et al.

FOREIGN PATENT DOCUMENTS

EP 1321957 A1 6/2003
JP 08-021967 A 1/1996
JP 2001-076605 A 3/2001
JP 2001-143595 A 5/2001
JP 2001143595 A 5/2001
JP 2004-317744 A 11/2004

* cited by examiner

*Primary Examiner*—Elvin G Enad
*Assistant Examiner*—Bernard Rojas
(74) *Attorney, Agent, or Firm*—Sughrue Mion, PLLC

(57) ABSTRACT

A micro electro mechanical system switch and a method of fabricating the micro electro mechanical system switch. The micro electro mechanical system switch includes a substrate, a plurality of signal lines formed on the substrate and including switching contact points and a plurality of immovable electrodes formed among the signal lines on the substrate. A plurality of anchors protrude from the substrate to predetermined heights and support at least two actuating beams installed on an identical plane so as to move up and down. A connecting unit connects the at least two actuating beams. A support unit provided on the substrate supports the connecting unit and contacting plates are installed on lower surfaces of the at least two actuating beams so as to contact the switching contact points.

10 Claims, 6 Drawing Sheets

MEMS SWITCH AND METHOD OF FABRICATING THE SAME

CROSS-REFERENCE TO RELATED APPLICATIONS

This application claims the benefit of Korean Patent Application No. 2004-107857 filed Dec. 17, 2004, in the Korean Intellectual Property Office, the disclosure of which is incorporated herein by reference.

BACKGROUND OF THE INVENTION

1. Field of the Invention

The present invention relates to a Micro Electro Mechanical System (MEMS) switch and a method of fabricating the same and, more particularly, to an MEMS switch which can be driven at a low voltage and solve an occurrence of a stiction fail and a method of fabricating the same.

2. Description of the Related Art

Many electronic systems used in a high frequency band have been made subminiature, ultralight, and high-performance. Thus, subminiature micro switches have been widely studied using a new technique called Micro Machining to replace semiconductor switches such as field effect transistors (FETs) or pin diodes used to control signals in such electronic systems.

RF switches of radio frequency (RF) devices using MEMS technology are widely manufactured. The RF switches are devices mainly applied to circuits selecting and transmitting signals and matching impedances in wireless telecommunication terminals and systems in a micro wave band or a millimeter wave band.

U.S. Pat. No. 6,307,169 discloses such a MEMS switch.

The disclosed MEMS switch includes a hinge supporting a membrane type electrode on a substrate. The hinge includes a control electrode connected to the substrate by an anchor, a hinge collar, and a hinge arm set. The control electrode includes a shorting bar that can be separated from and/or connected to the control electrode. In addition, a travel stop is provided between the substrate and the control electrode to prevent a stiction from occurring.

Japanese Publication Pat. No. hei 2001-143595 discloses another example of an MEMS switch.

The disclosed MEMS switch uses a micro plate frame structure suspended on a spring suspension system and is formed on a substrate. The spring suspension system includes an end to which an anchor is adhered and extends substantially orthogonally to a signal line. The micro plate frame includes a short piece opposite to a gap in the signal line, and an electric contact point post is formed on the signal line to form a condenser structure. A selected voltage is applied to the condenser structure so that the condenser structure is pulled toward a lower electrode due to a static electricity.

A MEMS switch as described above uses an electrostatic force. Thus, a drive voltage is great and a stiction phenomenon occurs. In the stiction phenomenon, an unintentional adhesion occurs on a surface of a micro structure, and thus a restoration force fails to overcome a force working on a surface such as a capillary force, a Van der Walls force, an electrostatic force, or the like. As a result, the adhesion permanently occurs.

SUMMARY OF THE INVENTION

Accordingly, the present general inventive concept has been made to solve the above-mentioned and/or problems, and an aspect of the present general inventive concept is to provide a MEMS switch which can be driven at a low voltage and reduce a stiction fail.

Another aspect of the present general inventive concept is to provide a method of fabricating the MEMS switch.

According to an aspect of the present invention, there is provided a micro electro mechanical system switch including a substrate; a plurality of signal lines formed on the substrate and including switching contact points; a plurality of immovable electrodes formed among the signal lines on the substrate; a plurality of anchors protruding from the substrate to predetermined heights; at least two actuating beams supported by the plurality of anchors and installed on an identical plane so as to move up and down; a connecting unit connecting the at least two actuating beams; a support unit provided on the substrate so as to support the connecting unit; and contacting plates installed on lower surfaces of the at least two actuating beams so as to contact the switching contact points.

The connecting unit may be connecting bars which are positioned on an identical plane to the at least actuating beams and which form identical bodies with the at least actuating beams, and the support unit may be support protrusions protruding from the substrate to predetermined heights and facing the connecting bars.

The anchors may be formed to identical heights to the support protrusions, and the actuating beams and the connecting bars may be formed so as to keep predetermined distances from the anchors and the support protrusions.

A plurality of connecting bars may be formed so as to keep predetermined distances from one another, and a plurality of support protrusions may be formed to keep predetermined distances from one another so as to cross the connecting bars.

The signal lines may be an input line and a plurality of output lines and radial from a center of the substrate, and the actuating beams may be disposes at predetermined angles so as to face the signal lines.

The actuating beams may be insulating layers and electrodes formed on upper surfaces of the insulating layers to predetermined thicknesses. The insulating layers may be formed of silicon nitride, and the electrodes may be formed of aluminum.

The connecting unit may form a single body with the insulating layers of the actuating beams on the insulating layers.

The actuating beams may include support bars supported on upper surfaces of the anchors at sides opposite to sides at which the connecting unit is formed.

According to another aspect of the invention, a method of fabricating a micro electro mechanical system switch, includes forming a plurality of anchors and a support unit on a substrate; depositing a metal layer on an upper surface of the substrate on which the anchors and the support unit are formed; patterning the metal layer to form a plurality of immovable electrodes and a plurality of signal lines; forming a first sacrificial layer covering the plurality of immovable electrodes, the plurality of signal lines, and the support unit; planarizing the first sacrificial layer to a predetermined thickness; depositing a second sacrificial layer on an upper surface of the first sacrificial layer to a predetermined thickness and patterning contact plate throughholes; depositing a contacting plate layer on an upper surface of the second sacrificial layer and patterning contacting plates buried in the contacting plate throughholes; forming actuating beams on an upper surface of the second sacrificial layer on which the contacting plates are formed and then patterning a connecting unit connecting at least two actuating beams and the actuating beams; and removing the first and second sacrificial layers.

The substrate may be etched to form the anchors and the support unit so as to form a single body with the substrate.

The support unit may be formed as square pillar-shaped support protrusions to an identical heights to the anchors at predetermined gaps from one another, and the connecting unit may be formed as a plurality of connecting bars at predetermined gaps from one another so as to cross the support protrusions.

The first sacrificial layer may be planarized to a thickness enough to keep a predetermined distance from upper surfaces of the anchors and the support protrusions.

The first sacrificial layer may be planarized by etch back.

Forming the actuating beams may include: forming insulating layers corresponding to actuating beam patterns; and forming electrodes on upper surfaces of the insulating layers.

The connecting unit may be patterned to form a single body with the insulating layers so as to form the insulating layers.

The signal lines may be radially formed as switching contact points at predetermined gaps from one another from the substrate, and the immovable electrodes may be interposed between the signal lines.

The actuating beams may be formed at predetermined angles from the center of the substrate so as to position above the signal lines.

Patterning the actuating beams and the connecting unit may include: patterning support bars supported on upper surfaces of the anchors at ends of the actuating beams opposite to sides at which the connecting unit is formed.

BRIEF DESCRIPTION OF THE DRAWINGS

The above aspects and features of the present invention will be more apparent by describing certain exemplary embodiments of the present invention with reference to the accompanying drawings, in which.

DETAILED DESCRIPTION OF ILLUSTRATIVE, NON-LIMITING, EMBODIMENTS OF THE INVENTION

Figure 1:
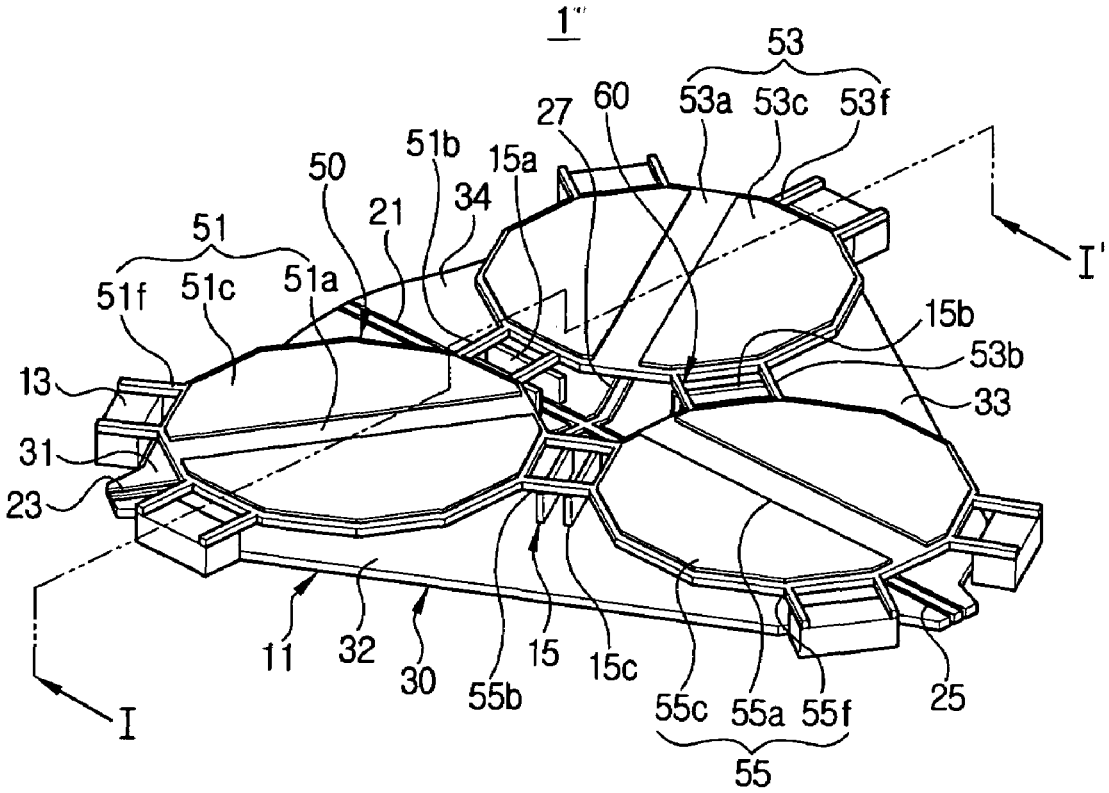
FIG. 1 is a schematic perspective view of a MEMS switch, i.e., a SP3T type micro switch, according to an exemplary embodiment of the present invention.

Certain exemplary embodiments of the present invention will be described in greater detail with reference to the accompanying drawings.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Hereinafter, exemplary embodiments of the present invention will be described with reference to the attached drawings.

Figure 2:
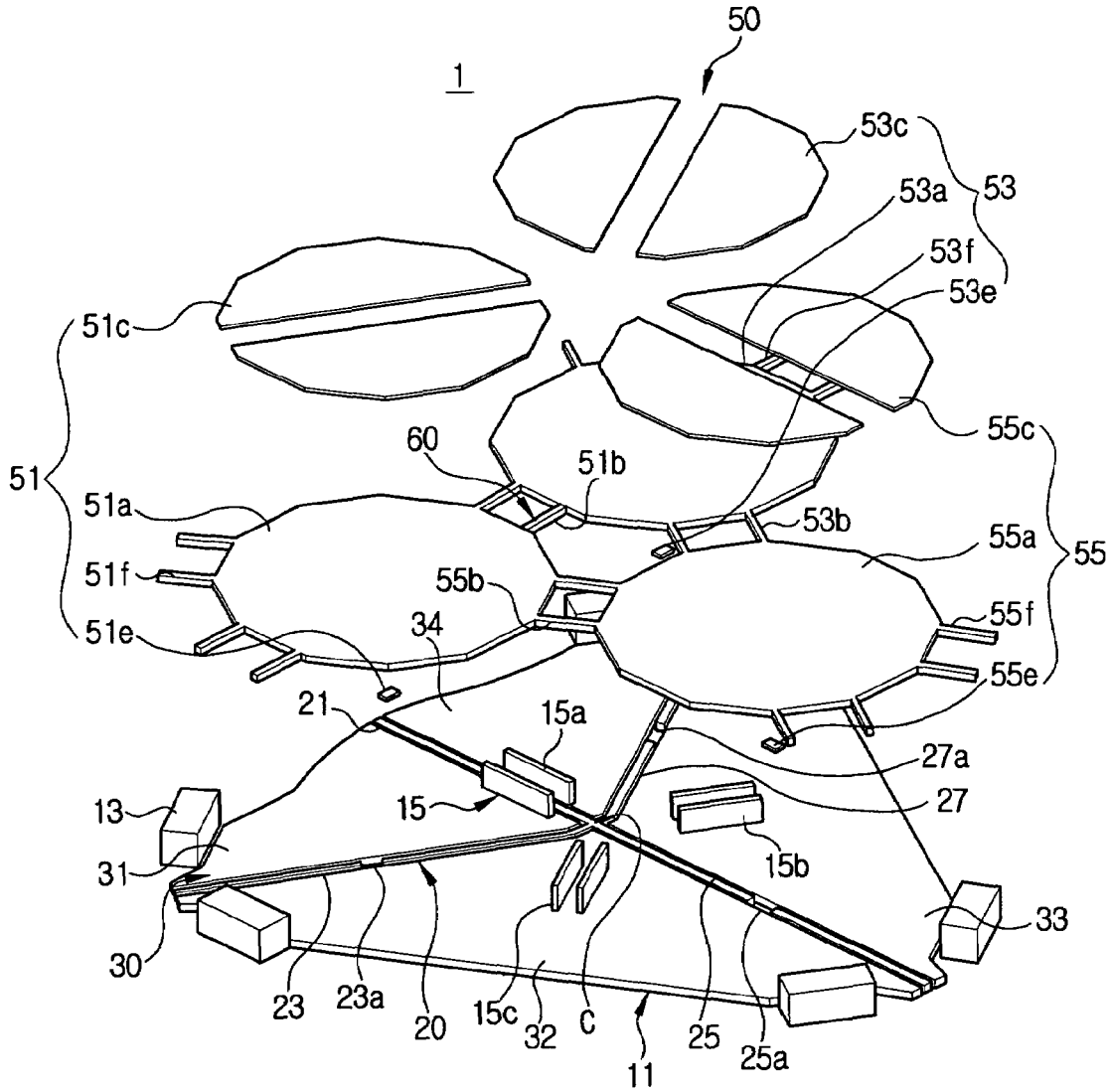
FIG. 2 is an exploded perspective view of the MEMS switch shown in FIG. 1.
Figure 3:
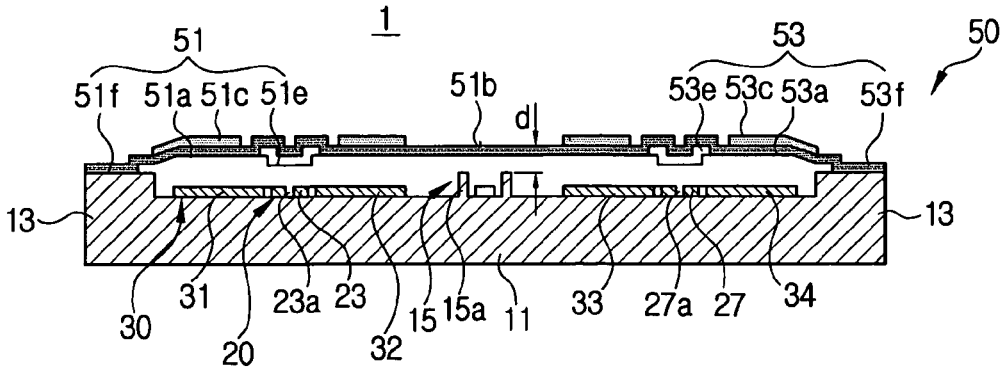
FIG. 3 is a cross-sectional view taken along line I-I' shown in FIG. 1.

Referring to FIGS. 1 through 3, a micro switch 1 includes a substrate 11, a signal line 20, an immovable electrode 30, and an actuating beam 50.

The substrate 11 has a high resistance characteristic. For example, the substrate 11 is formed of a silicon wafer or the like, and a plurality of anchors 13 are formed at an outer side of the substrate 11. In other words, a pair of anchors 13 are installed at each of three places of the outer side of the substrate 11 so as to support ends of three actuating beams 51, 53, and 55 that will be described later. First, second, and third support protrusions 15*a*, 15*b*, and 15*c* constituting a support unit 15 are formed inside the substrate 11. Here, heights of the anchors 13 are the same as those of the first, second, and third support protrusions 15*a*, 15*b*, and 15*c*.

The signal line 20 including an input line 21 and first, second, and third output lines 23, 25, and 27 is provided on an upper surface of the substrate 11, and immovable electrodes 31, 32, 33, and 34 as ground electrodes are formed beside sides of the input line 21 and the first, second, and third output lines 23, 25, and 27. Here, first, second, and third switching contact points 23*a*, 25*a*, and 27*a* are formed on the first, second, and third output lines 23, 25, and 27 at predetermined gaps. The input line 21 and the first, second, and third output lines 23, 25, and 27 are radially formed from a center C of the substrate 11. The signal line 20 (the input line 21 and the first, second, and third output lines 23, 25, and 27) has a simpler structure due to the above-described structure so as to reduce a loss rate of a signal transmission.

The actuating beam 50, i.e., the first, second, and third actuating beams 51, 53, and 55, are supported on upper surfaces of the output lines 23, 25, and 27 by the anchors 13 provided at the outermost side of the substrate 11. Here, the first, second, and third actuating beams 51, 53, and 55 are installed on the same plane and connected to one another via a connecting unit 60, i.e., first, second, and third connecting bars 51*b*, 53*b*, and 55*b*.

The first, second, and third actuating beams 51, 53, and 55 respectively include first, second, and third insulating layers 51*a*, 53*a*, and 55*a* intercepting electric connection with the immovable electrodes 31, 32, 33, and 34, first, second, and third electrodes 51*c*, 53*c*, and 55*c* formed on upper surfaces of the first, second, and third insulating layers 51*a*, 53*a*, and 55*a* and supplied with drive voltages, and first, second, and third contacting plates 51*e*, 53*e*, and 55*e* installed on lower surface of the first, second, and third insulating layers 51*a*, 53*a*, and 55*a* so as to contact the first, second, and third switching contact points 23*a*, 25*a*, and 27*a*.

First, second, and third support bars 51*f*, 53*f*, and 55*f* are provided at other ends of the first, second, and third insulating layers 51*a*, 53*a*, and 55*a* opposite to ends at which the first, second, and third connecting bars 51*b*, 53*b*, and 55*b* are formed, to contact upper surfaces of the anchors 13 so as to support and hinge ends of the first, second, and third actuating beams 51, 53, and 55. The anchors 13 are provided so as to face the first, second, and third support bars 51*f*, 53*f*, and 55*f*.

The ground electrode (immovable electrode) 30 (31, 32, 33, and 34) around the signal line 20 provides a waveguide of an RF signal input through the signal line 20 together with the signal line 20.

The first, second, and third insulating layers 51*a*, 53*a*, and 55*a* prevent signals from flowing toward the ground electrode, i.e., the immovable electrode 30, when the micro switch 1 is turned on.

As described above, as shown in FIG. 3, the actuating beam 50 keeps a predetermined distance d from upper surfaces of the first, second, and third support protrusions 15*a*, 15*b*, and 15*c* in an initial state in that voltages are not applied to the first, second, and third electrodes 51*c*, 53*c*, and 55*c*.

The operation of the MEMS switch 1 having the above-described structure will now be described.

Figure 4A:
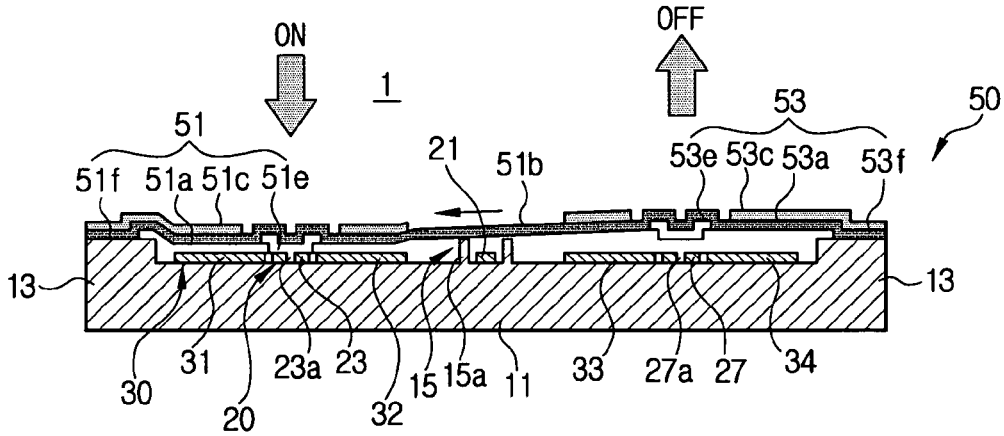
FIGS. 4A and 4B are cross-sectional views illustrating an operation of the MEMS switch shown in FIG. 1.
Figure 4B:
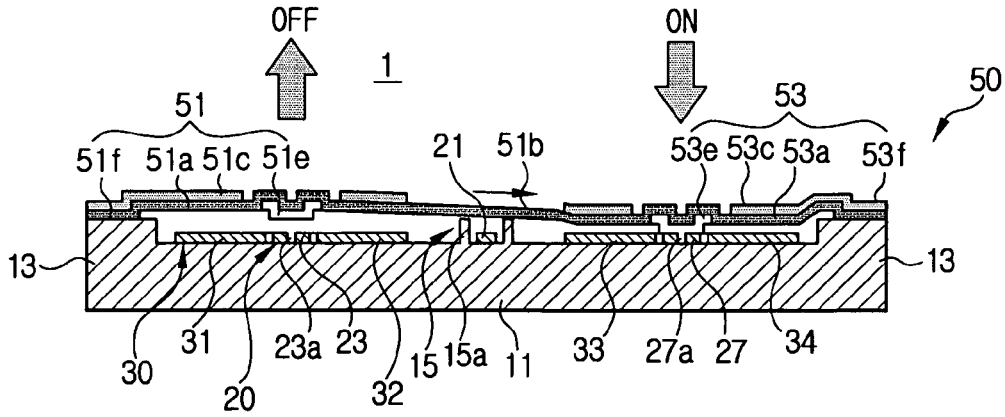

FIGS. 4A and 4B are views illustrating the operation of the MEMS switch 1 shown in FIG. 1.

As shown in FIG. 4A, when a voltage is applied via the first electrode 51*c* of the first actuating beam 51, the first actuating beam 51 is bent down by an electrical force generated between the first actuating beam 51 and the immovable electrodes 31 and 32 that are the ground electrodes so that the first contacting plate 51*e* contacts the first switching contact point 23*a*. Thus, a resistance variation occurs between the first contacting plate 51*e* and the first output line 23. In other words, when the first contacting plate 51*e* is in a normal position (in a state shown in FIG. 3), an impedance is high. When the first contacting plate 51*e* contacts the first switching contact point 23*a* due to an electrostatic force, the impedance is lower. Thus, the MEMS switch 1 is turned on.

If the first actuating beam 51 descends so as to turn on the MEMS switch 1, the first connecting bar 51*b* is hung on a corner of an upper surface of the first support protrusion 15*a* so as to be pulled toward a direction indicated by an arrow. Thus, the second actuating beam 53 is pulled along the direction indicated by the arrow. As a result, although a stiction phenomenon occurs at the second actuating beam 53, the second actuating beam 53 is automatically turned off so as to solve a stiction fail phenomenon. The third connecting bar 55*b* connecting the third actuating beam 53 and the first actuating beam 51 is also pulled toward the direction indicated by the arrow. Thus, the third actuating beam 55 is also automatically turned off so as to solve the stiction fail phenomenon (refer to FIGS. 1 and 2).

As shown in FIG. 4B, if a voltage of the first actuating beam 51 is released and a drive voltage is applied via the second electrode 53*c* of the second actuating beam 53, the second actuating beam 53 descends and the first connecting bar 51*b* is pulled toward the direction indicated by the arrow according to the above-described operation principle. Thus, the first actuating beam 51 is automatically turned off. As a result, the stiction fail phenomenon can be solved. Here, the second connecting bar 53*b* is also pulled toward the direction indicated by the arrow. Thus, the third actuating beam 55 is also automatically turned off so as to solve the stiction fail phenomenon (refer to FIGS. 1 and 2).

As described above, when one of N switches operates, the others of the N switches are automatically turned off. Thus, although a low voltage drive is performed, an occurrence of a stiction fail can be solved. Therefore, an MEMS switch can be more efficiently driven even at a low voltage.

A process of fabricating the micro switch 1 will now be described in more detail.

FIGS. 5A through 5I are cross-sectional views taken along line I-I' shown in FIG. 1 to illustrate a process of fabricating the micro switch 1. A portion in which the third actuating beam 55 is installed has the same structure as the first and second actuating beams 51 and 53, the portion being not shown in FIGS. 5A through 5I. Thus, the portion in which the third actuating beam 55 is formed will also be described with reference to FIG. 2.

Figure 5A:
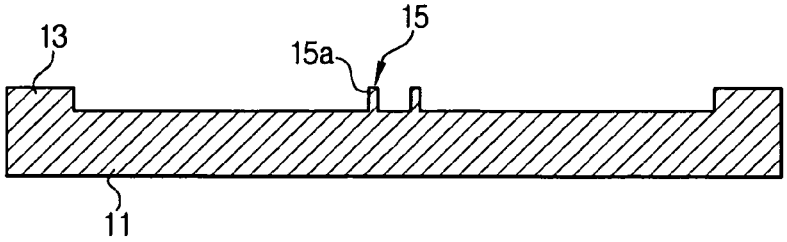
FIGS. 5A through 5I are cross-sectional views taken along line I-I' shown in FIG. 1 to illustrate a method of fabricating the MEMS switch shown in FIG. 1.

Referring to FIGS. 2 and 5A, for example, the plurality of anchors 13 and the first, second, and third support protrusions 15*a*, 15*b*, and 15*c* of the support unit 15 are formed on the substrate 11 having the high resistance such as the silicon wafer. Here, the anchors 13 and the support protrusion 15*a* are etched so as to have the same heights. Here, as shown in FIG. 2, a pair of anchors 13 are formed at each of the three places of the outer side of the substrate 11 so as to support an end of the actuating beam 50 that will be described later. The first, second, and third support protrusions 15*a*, 15*b*, and 15*c* are formed at three places of the center of the substrate 11 to each make a pair so as to support the first, second, and third connecting bars 51*b*, 53*b*, and 55*b* of the connecting unit 60 of the actuating beam 50.

Figure 5B:
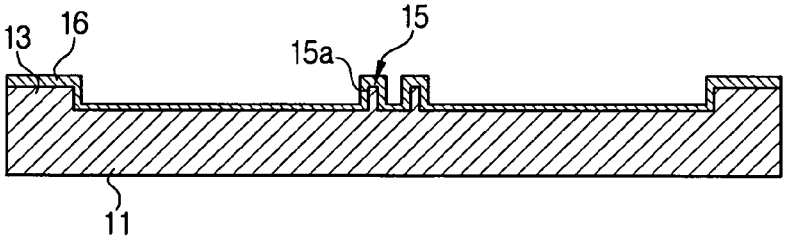
Figure 5C:
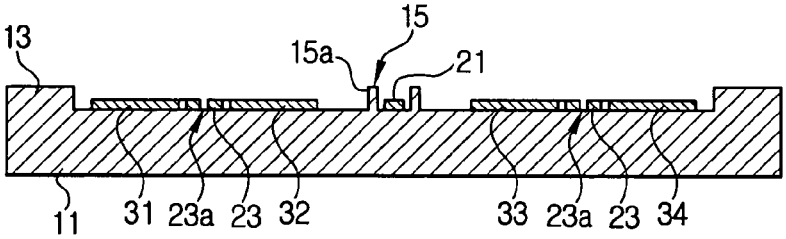

Referring to FIGS. 2, 5B, and 5C, a metal layer 16 is deposited on the anchors 13 and the first, second, and third support protrusions 15*a*, 15*b*, and 15*c*, and the signal line 20 (the input line 21 and the output lines 23, 25, and 27) and the immovable electrode 30 (31, 32, 33, and 34) that is the ground electrode are patterned. Here, the signal line 20 (the input line 21 and the output lines 23, 25, and 27) is radially formed from the center C of the substrate 11 so that the signal input through the input line 21 is divided into signals output through the output lines 23, 25, and 27. The output lines 23, 25, and 27 respectively include the switching contact points 23*a*, 25*a*, and 27*a* formed at predetermined gaps. The immovable electrodes 31, 32, 33, and 34 are interposed between the input line 21 and the output lines 23, 25, and 27.

Figure 5D:
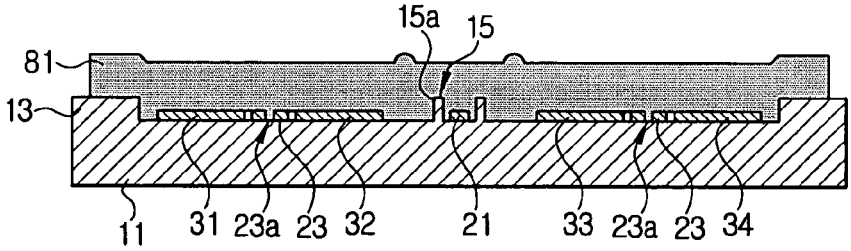

Referring to FIGS. 2 and 5D, a first sacrificial layer 81 is formed so as to cover the immovable electrodes 31, 32, 33, and 34 and the first, second, and third support protrusions 15*a*, 15*b*, and 15*c* of the support unit 15. Here, the sacrificial layer 81 is formed to provide a space in which the first, second, and third actuating beams 51, 53, and 55 that will be formed in a subsequent process and the connecting unit 60 (the first, second, and third connecting bars 51*b*, 53*b*, and 55*b*) are formed at predetermined distance d from upper surfaces of the first, second, and third support protrusions 15*a*, 15*b*, and 15*c* and move up and down. The first sacrificial layer 81 is formed of a photoresist to be coated on the substrate 11 using spin coating or the like.

Figure 5E:
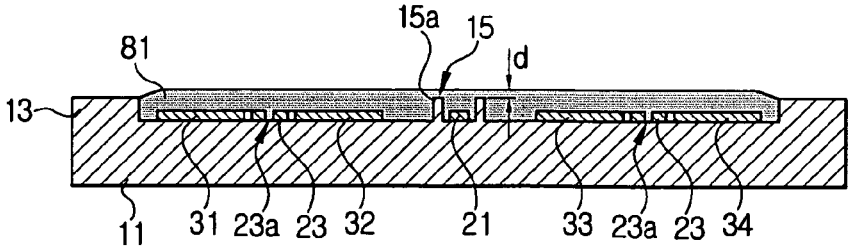

Referring to FIGS. 2 and 5E, an upper surface of the first sacrificial layer 81 is planarized by etch back. Here, the upper surface of the first sacrificial layer 81 is patterned to a thickness enough to keep a predetermined distance from the upper surfaces of the first, second, and third support protrusions 15*a*, 15*b*, and 15*c*. This is to form the actuating beam 50 (the first, second, and third actuating beams 51, 53, and 55) formed on the same plane and the connecting unit 60 (the first, second, and third connecting bars 51*b*, 53*b*, and 55*b*) so that they keep predetermined distances d as shown in FIG. 3.

Figure 5F:
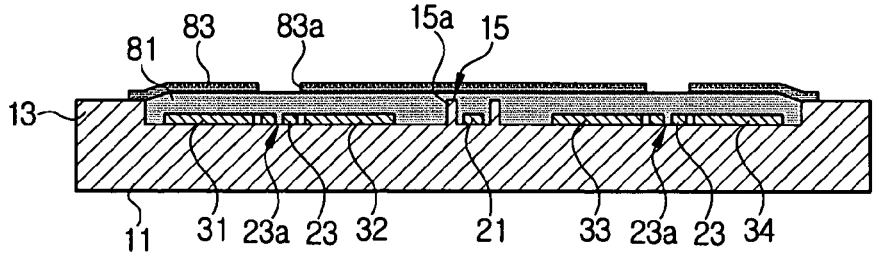

Referring to FIG. 5F, a second sacrificial layer 83 formed of a photoresist layer is coated on the upper surface of the first sacrificial layer 81 to a predetermined thickness. Positions of the second sacrificial layer 83 opposite to the first, second, and third switching contact points 23*a*, 25*a*, and 27*a* of the first, second, and third output lines 23, 25, and 27 are patterned so as to pattern contacting plate throughholes 83*a*. Here, the contacting plate throughholes 83*a* contact the first, second, and third switching contact points 23*a*, 25*a*, and 27*a* and are patterned as portions burying the first, second, and third contacting plates 51*e*, 53*e*, and 55*e* using a photolithography method.

Figure 5G:
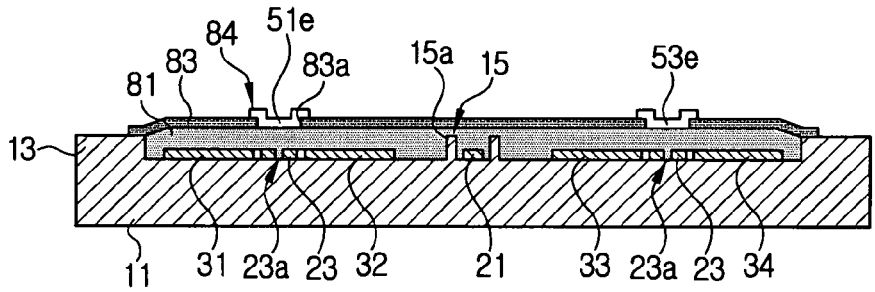

Referring to FIGS. 2 and 5G, a contacting plate layer is deposited on an upper surface of the second sacrificial layer 83 using a thin film apparatus, for example, a chemical vapor deposition (CVD) apparatus or the like. The first, second, and third contacting plates 51*e*, 53*e*, and 55*e* are patterned using an etching apparatus. Here, the first, second, and third contacting plates 51*e*, 53*e*, and 55*e* are patterned so that only their portions buried via the contacting plate throughholes 83*a* are left, the portions contacting the first, second, and third switching contact points 21*a*, 23*a*, and 25*a* of the first, second, and third output lines 23, 25, and 27. The first, second, and third contacting plates 51*e*, 53*e*, and 55*e* are formed of metal layers.

Figure 5H:
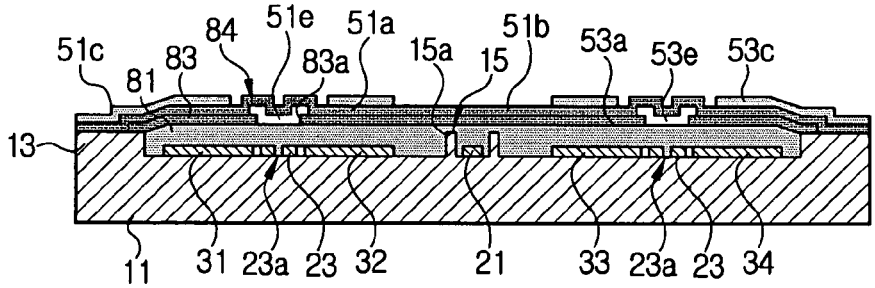

Referring to FIGS. 2 and 5H, an insulating layer constituting the actuating beam 50 (the first, second, and third actuating beams 51, 53, and 55) and formed of silicon nitride is deposited and then is patterned as the first, second, and third insulating layers 51*a*, 53*a*, and 55*a* in shapes corresponding to the first, second, and third actuating beams 51, 53, and 55. An electrode layer formed of a conductive material such as aluminum or the like is deposited and patterned as the electrodes 51*c*, 53*c*, and 55*c* in shapes corresponding to the first, second, and third actuating beams 51, 53, and 55 so as to complete the first, second, and third actuating beams 51, 53, and 55.

The first, second, and third insulating layers 51*a*, 53*a*, and 55*a* are patterned in circular shapes, and the connecting bars 51*b*, 53*b*, and 55*b* of the connecting unit 60 connecting the first, second, and third insulating layers 51*a*, 53*a*, and 55*a* are patterned. The other ends of the first, second, and third insulating layers 51*a*, 53*a*, and 55*a* opposite to ends of the insulating layers 51*a*, 53*a*, and 55*a* at which the first, second, and third connecting bars 51*b*, 53*b*, and 55*b* are formed may be additionally patterned as the first, second, and third support bars 51*f*, 53*f*, and 55*f* to improve up-and-down mobility of the first, second, and third actuating beams 51, 53, and 55.

Figure 5I:
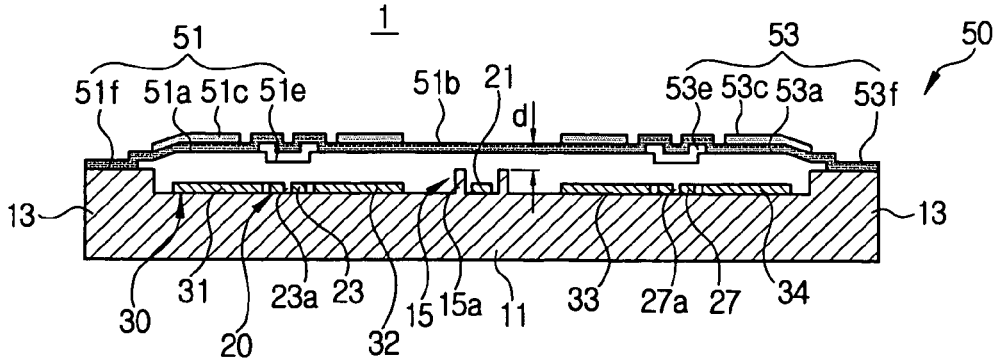

Referring to FIGS. 2 and 5I, the first and second sacrificial layers 81 and 83 are removed by an ashing apparatus to complete the MEMS switch 1.

As described above, a signal input via an input line is divided into three parts. However, an SPDT in which a signal input via an input line is divided into two parts may be applied. An SPNT in which a signal input via an input line is divided into N parts may also be applied.

Figure 6:
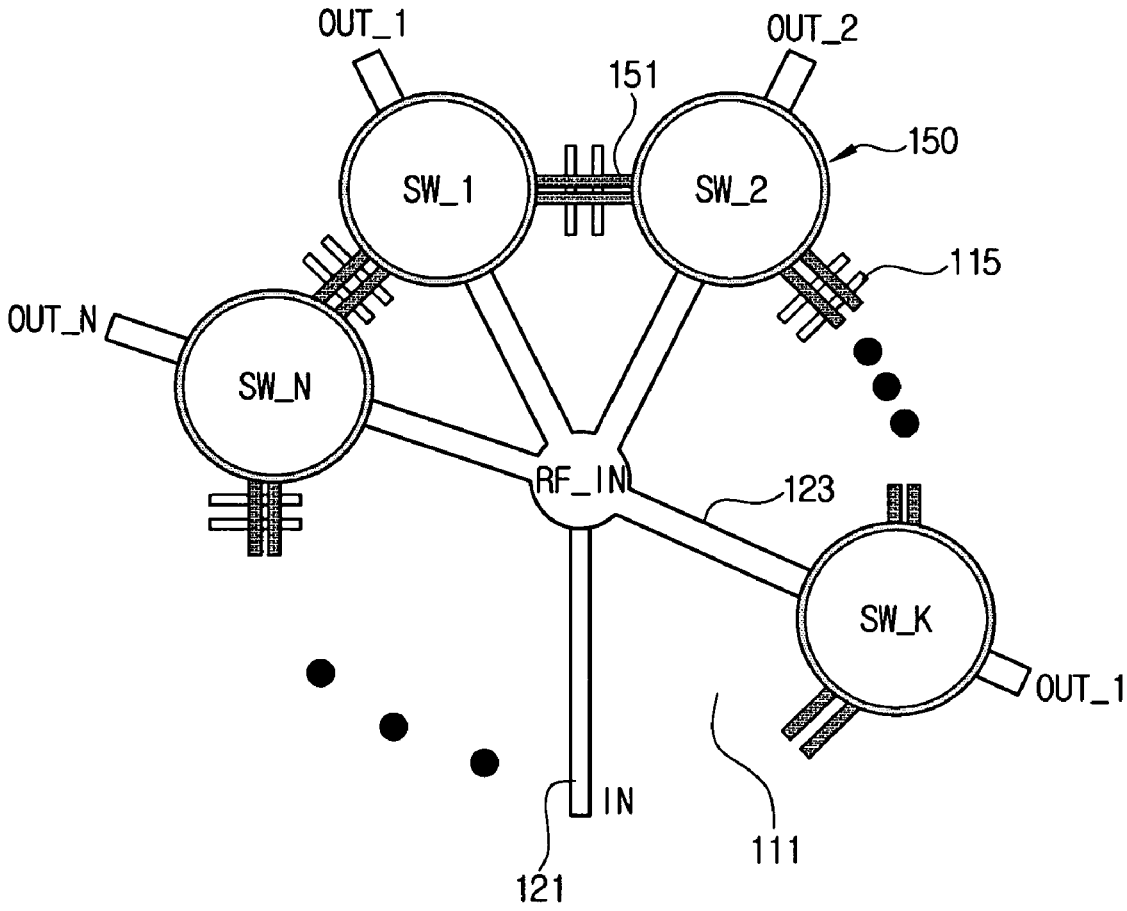
FIG. 6 is a view of an MEMS switch, i.e., a Single Pole N Through (SPNT) type MEMS switch in which a signal input through a input line is divided into N signals so as to be input into N output lines, according to another exemplary embodiment of the present invention.

FIG. 6 is a view illustrating a SPNT type micro switch in which a signal input via an input line is divided into N parts output through N output lines.

As shown in FIG. 6, the basic structure of the SPNT type micro switch is similar to that of the micro switch shown in FIGS. 1 through 3. Thus, an input line 121 and N output lines 123 are formed on a plurality of substrates 111. A plurality of actuating beams 150 are disposed on the same plane over the output lines 123 so as to face the output lines 123. The actuating beams 150 are connected to one another via connecting bars 151, and support protrusions 115 are additionally formed on the plurality of substrates 111 so as to support the connecting bars 151. Such a structure of the SPNT type micro switch is the same as that of the micro switch shown in FIGS. 1 through 3, and the SPNT type micro switch is fabricated according to the process described with reference to FIGS. 5A through 5I. Thus, the description of the process of fabricating the SPNT type micro switch will be omitted.

As described above, in an MEMS switch and a method of fabricating the MEMS switch according to the present invention, a plurality of actuating beams can be formed on the same plane. Thus, in a case where a switch is turned on, the other switches can be automatically turned off. As a result, a stiction fail can be efficiently reduced.

Also, since the other switches are automatically turned off when the switch is turned on, a low voltage drive is possible.

In addition, signal lines can be radially disposed from the center of a substrate. The actuating beams can be disposed at predetermined angles on the same plane. Thus, the signal lines can be simplified. As a result, a loss rate of a signal transmission can be efficiently reduced.

The foregoing exemplary embodiments and advantages are merely exemplary and are not to be construed as limiting the present invention. The present teaching can be readily applied to other types of apparatuses. Also, the description of the exemplary embodiments of the present invention are intended to be illustrative, and not to limit the scope of the claims, and many alternatives, modifications, and variations will be apparent to those skilled in the art.

What is claimed is:

1. A micro electro mechanical system switch comprising:

a substrate;

a plurality of signal lines formed on the substrate and comprising switching contact points;

a plurality of immovable electrodes formed among the signal lines on the substrate;

a plurality of anchors protruding from the substrate to predetermined heights;

at least two actuating beams supported by the plurality of anchors and installed on an identical plane so as to move up and down;

a connecting unit connecting the at least two actuating beams;

a support unit provided on the substrate so as to support the connecting unit and thus support the adjacent actuating beams to be movable in the form of a seesaw relative to each other; and contacting plates installed on lower surfaces of the at least two actuating beams so as to contact the switching contact points.

2. The micro electro mechanical system switch of claim 1, wherein:

the connecting unit comprises connecting bars which are positioned on the identical plane of the at least two actuating beams and which form integral bodies with the at least two actuating beams; and the support unit is support protrusions protruding from the substrate to predetermined heights and facing the connecting bars.

3. The micro electro mechanical system switch of claim 1, wherein:

the anchors are formed to identical heights to the support protrusions; and the actuating beams and the connecting bars are formed so as to keep predetermined distances from the anchors and the support protrusions.

4. The micro electro mechanical system switch of claim 2, wherein:

a plurality of connecting bars are formed so as to keep predetermined distances from one another; and a plurality of support protrusions are formed to keep predetermined distances from one another so as to cross the connecting bars.

5. The micro electro mechanical system switch of claim 1, wherein:

the signal lines are an input line and a plurality of output lines and extend radially from a center of the substrate; and the actuating beams are disposed at predetermined angles so as to face the signal lines.

6. The micro electro mechanical system switch of claim 1, wherein the actuating beams are insulating layers and electrodes formed on upper surfaces of the insulating layers to predetermined thicknesses.

7. The micro electro mechanical system switch of claim 6, wherein the insulating layers comprise silicon nitride.

8. The micro electro mechanical system switch of claim 6, wherein the electrodes comprise aluminum.

9. The micro electro mechanical system switch of claim 6, wherein the connecting unit forms a single body with the insulating layers of the actuating beams on the insulating layers.

10. The micro electro mechanical system switch of claim 1, wherein the actuating beams comprise:

support bars supported on upper surfaces of the anchors at sides opposite to sides at which the connecting unit is formed.

* * * * *